US005705261A

United States Patent [19]

Axelson

[11] Patent Number: 5,705,261

[45] Date of Patent: Jan. 6, 1998

[54] ACTIVE METAL METALLIZATION OF MINI-IGNITERS BY SILK SCREENING

[75] Inventor: Scott R. Axelson, Milford, N.H.

[73] Assignee: Saint-Gobain/Norton Industrial Ceramics Corporation, Worcester, Mass.

[21] Appl. No.: 144,078

[22] Filed: Oct. 28, 1993

[51] Int. Cl.[6] ..... B32B 3/00; B32B 9/04; B32B 9/00; H05B 3/10

[52] U.S. Cl. ..... 428/210; 428/209; 428/446; 428/698; 428/699; 219/553; 373/117; 252/516; 501/91; 501/96

[58] Field of Search ..... 428/210, 209, 428/446, 698, 699; 219/553; 373/117; 252/516; 501/91, 96

[56] References Cited

U.S. PATENT DOCUMENTS

| | | | |
|---|---|---|---|
| 3,006,069 | 10/1961 | Rhoads et al. | 29/473.1 |
| 3,779,804 | 12/1973 | Urban | 117/212 |
| 4,122,771 | 10/1978 | Barton et al. | 101/123 |
| 4,512,871 | 4/1985 | Kato et al. | 204/429 |
| 4,521,798 | 6/1985 | Baker | 357/30 |
| 4,544,611 | 10/1985 | Rellick | 428/673 |
| 4,555,358 | 11/1985 | Matsushita et al. | 252/516 |
| 4,818,821 | 4/1989 | Wentworth et al. | 257/701 |
| 4,835,344 | 5/1989 | Iyogi et al. | 174/68.5 |
| 4,883,745 | 11/1989 | Mizuhara | 420/502 |
| 5,045,237 | 9/1991 | Washburn | 252/516 |
| 5,367,195 | 11/1994 | DiGiacomo et al. | 257/767 |

*Primary Examiner*—Cathy F. Lam
*Attorney, Agent, or Firm*—Thomas M. DiMauro

[57] ABSTRACT

A ceramic igniter comprising: a) a lead wire, b) a ceramic substrate, and c) a braze pad having a thickness of less than about 150 microns, wherein the lead wire and ceramic substrate are placed in electrical connection by the braze pad.

12 Claims, 1 Drawing Sheet

ACTIVE METAL METALLIZATION OF MINI-IGNITERS BY SILK SCREENING

TECHNICAL FIELD

This invention relates to ceramic igniters and an improved method of making necessary electrical connections thereto. The improved electrical connections to the ceramic igniters are produced by silk screening a braze pad onto an electrically conductive portion of an igniter and then soldering an electrical lead wire to the braze pad. Careful silk screening provides good control of the braze pad thickness. Thin braze pads so produced are less affected by thermal shock and so are less prone to cause thermal expansion-induced fracture of the ceramic.

BACKGROUND OF THE INVENTION

Although ceramic igniters have been known and commercially used for many years, the art has been plagued by in-service resistivity increases as well as premature failure of the igniters' electrical connections. Ceramic igniter production requires constructing an electrical circuit through a ceramic component, a portion of which is highly resistive and thus rises in temperature when current is run through it from an electrical lead. However, the conductive interface between the electrical lead and the ceramic typically experiences dissimilar thermal expansion effects from the lead and the ceramic and so is susceptible to cracking. Further, undesired highly resistive zones are often created by either reaction between the metal lead and the ceramic, any other chemical interaction used in forming the combined mechanical and electrical connection, mechanical failure or chemical deterioration, i.e., oxidation. Such large increases in resistance are a problem because an igniter must be capable of igniting fuel gases throughout the lifetime of an appliance, even when voltages sink as low as 85% of the standard operating voltage (i.e., 20.4 V instead of 24.0 V) during brownouts or peak electrical demand periods. When the available voltage decreases significantly, an insufficient igniter temperature may result, particularly in older igniters in which the electrical contact has experienced severe deterioration. Hence, achieving both consistent resistivity and electrical continuity has been a continuing goal in this field.

Previous attempts at making electrical connections for ceramic igniters have had varied results. For example, U.S. Pat. No. 3,875,477 discloses a process involving (i) lightly sandblasting portions of a silicon carbide igniter in the areas where the electrical contacts are to be made, (ii) coating the sandblasted terminal ends with aluminum metal or an aluminum alloy either by dipping into molten metal or by flame spraying, and (iii) using a refractory, electrically insulating cement of the high alumina type. U.S. Pat. No. 3,928,910 discloses gas igniters having electrical leads bonded into physical slots of a ceramic (SiC) body by high temperature flame or plasma spraying which is not only intended to secure the inserted leads into their respective slots but also to fully and continuously encase the terminal parts of the igniter. U.S. Pat. No. 5,045,237 discloses molybdenum disilicide-containing ceramic igniters in which a simple machine screw and nut assembly is placed through machined holes in the ceramic body. However, the above connection means in each of these references has suffered from the problem of either substantially increased resistance with extended use, i.e., at least about a 5% increase after 100,000 on/off cycles, or failing to be commercially reproducible.

The Norton Company of Worcester, Mass. has produced ceramic igniters in which the electrical contacts have less than about a 2% change in contact resistance after 100,000 on/off cycles. These igniters are prepared by (i) forming a ceramic igniter body having a molybdenum disilicide content of at least about 20 volume percent at the points at which the electrical contacts are to be made, (ii) painting an active metal braze on the body at those points, and (iii) soldering electrical leads to said pads by means of a solder which melts at a temperature of greater than about 500° C. However, thermal expansion mismatch between the braze and the ceramic often produces cracking in the braze, leading to failure of the electrical connection.

Accordingly, it is the object of the present invention to produce a commercially viable improved ceramic igniter which (i) will maintain a desired contact resistance after significant use, and (ii) has the desired thermal expansion characteristics in the braze.

SUMMARY OF THE INVENTION

In accordance with the present invention, there is provided a ceramic igniter comprising:

a) a lead wire, b) a ceramic substrate, and c) a braze pad having a thickness of less than about 150 microns, wherein the lead wire and ceramic substrate are placed in electrical connection by the braze pad.

Also in accordance with the present invention, there is provided a process for making an improved ceramic igniter comprising an electrically conductive ceramic substrate, comprising the steps of:

(a) silk screening a braze material onto the electrically conductive ceramic substrate to produce a braze pad, and (b) soldering an electrical lead to said braze pad by means of a solder which melts at a temperature of at least about 500° C.

DESCRIPTION OF THE PREFERRED EMBODIMENTS

Figure 1:
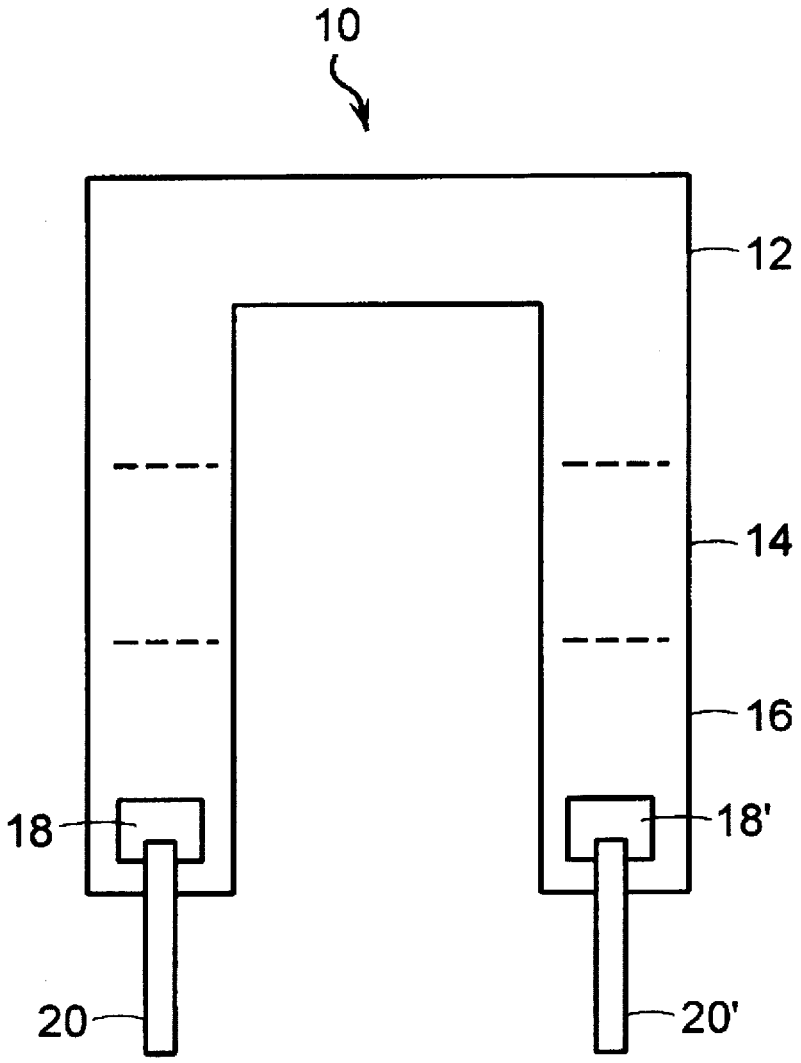
FIG. 1 is a top view of a preferred igniter body with connecting leads soldered to braze pads in accordance with this invention.

Without wishing to be tied to a theory, it is believed that the conventional method of painting the braze onto the ceramic substrate deposited more braze than was needed to make the required electrical contact. The volume changes experienced by this excessive braze during temperature swings is believed to be enough to cause the fracture of the ceramic under the braze and the failure of the circuit. Such temperature swings are believed to occur during construction of the igniter and during use. By silk screening the braze onto the ceramic in a highly controlled manner, the braze can be tailored to sufficiently thin and narrow dimensions, thereby preventing the deposition of the excessive braze and avoiding thermal expansion-induced fracture of the braze pad and failure of the electrical connection. Accordingly, the igniters of the present invention not only maintain the desired long term contact resistance (due to the use of a braze) but also have the desired thermal expansion characteristics (due to the thin depth of the braze).

The silk screening of the braze onto the ceramic may be accomplished by any conventional silk screening method. In one embodiment, a Model #SP-SA-5 silk screen unit, available from deHaart, Inc. of Burlington, Mass., is used. When this unit is used, however, it must first be initialized with reference to the ceramic igniter in order to assure proper registration of the braze pattern on the igniter. In one initialization procedure, a brass nest, available from Hermetric, Inc. of Burlington, Mass., is mounted on a vacuum base plate on the printing table of the unit. Ultrasonicaly cleaned igniter elements are then placed on the table and held in place either via a vacuum or with light adhesive tape. Concurrently, a polymer mesh screen, available from RIV Inc. of Merrimac, N.H., is mounted on the underside of a squeegee frame, which is then lowered into screening position in the unit in order to set the height between the screen and the igniters in the fixture. A feeler gauge is used to first adjust the separation distance to about 0.0015 inches (38.1 microns). This distance is then set back an additional 0.020 inches (508 microns) to allow for screen snapback. The squeegee pressure is set for about 20 psi downforce. The screen is then removed from the frame to set the squeegee-nest fixture separation. The front application squeegee is adjusted for about 0.001 inch separation (25.4 microns) while the rear application squeege is adjusted for about 0.016 inch separation (406.4 microns), both being set by a feeler gauge and micrometer dial. The screen is then reinstalled on the squeegee frame. The registration of the screen pattern with the elements in the nesting fixture is then set using the x-y axis micrometer dial adjustments on the printing table. Igniter blanks are placed in the fixture and braze paste having a suitable viscosity for screening is applied to the screen with a spatula. The unit is then turned on and the braze is applied to the igniter blanks. The blanks are then inspected visually and x-y adjustment is made to center the metallization on the igniter leg, preferably to within about 0.25 inches (6350 microns) of the end of the leg. This process is then repeated until the proper registration is achieved.

A braze pad produced from the silk screening process of the present invention typically has a thickness of less than about 150 microns, preferably less than about 115 microns, more preferably less than about 80 microns. Without wishing to be tied to a theory, this reduced-thickness pad lessens the thermal expansion response of the braze pad during periods of thermal shock.

The pads typically have an exposed surface area of less than about 3.6 square millimeters, preferably less than about 2.6 square millimeters and more preferably less than about 2.2 square millimeters. In practice, it has been found that the exposed surface area of the braze pad should be as small as possible and centered on the end of the igniter leg in order to insure that the pad is not contacting machining edge flaws left from the ceramic element manufacturing process.

The braze composition used with the present invention may be any braze composition conventional in the art which forms an electrical connection with the highly conductive portions of the ceramic igniter. To obtain the required high degree of adhesion to the ceramic, the braze typically contains an active metal which can wet and react with the ceramic materials and so provide adherence thereto by filler metals contained in the braze. Examples of specific active metals include titanium, zirconium, niobium, nickel, palladium, and gold. Preferably, the active metal is titanium or zirconium. In addition to the active metal, the braze contains one or more filler metals such as silver, copper, indium, tin, zinc, lead, cadmium, and phosphorous. Preferably a mixture of filler metals is used. Most preferably, the braze will comprise titanium as the active metal and a mixture of copper and silver as the filler metal. Generally, the braze will contain between about 0.1 and about 5 weight percent ("w/o") active metal and between about 99.9 and about 95 w/o filler metal. Such suitable brazes are commercially available under the trade name Lucanex from Lucas-Milhaupt, Inc. of Cudahy, Wis., and Cusil and Cusin from Wesgo, Inc. of Belmont, Calif. Specific brazes found useful with the present invention include: Lucanex 721 and Cusil Braze, each of which contains about 70.5 w/o silver, about 27.5 w/o copper, and about 2 w/o titanium.

The ceramic portion of the present invention may be any ceramic commonly used in the igniter field. Preferably, the ceramic comprises aluminum nitride, molybdenum disilicide, and silicon carbide. More preferably, a mixture of aluminum nitride (AlN), molybdenum disilicide ($MoSi_2$) and silicon carbide (SiC), as disclosed in U.S. Pat. No. 5,045,237 ("the Washburn patent"), the specification of which is wholly incorporated by reference herein, is used.

The igniter preferably comprises about 40 to 70 volume percent ("v/o") of a nitride ceramic and about 30 to 60 v/o $MoSi_2$ and SiC in a volume ratio of from about 1:3 to 3:1. A more preferred igniter has a varying composition as described by the Washburn patent. FIG. 1 presents an igniter of the present invention wherein the chemical composition of the igniter 10 is varied from a highly resistive portion 12 through an intermediate portion 14 to a highly conductive portion 16. Preferably, however, the intermediate portion 14 is omitted for ease of manufacturing. The igniter is also provided with the two active metal braze pads 18 and 18' to which electrical leads 20 and 20' are respectively soldered in accordance with this invention.

The highly resistive portion 12 generally has a resistivity of at least about 0.04 ohm-cm, preferably at least about 0.07 ohm-cm in the temperature range of 1000° to 1600° C. It preferably comprises about 50 to 70 v/o nitride ceramic and about 30 to 50 v/o $MoSi_2$ and SiC in a volume ratio of about 1 part $MoSi_2$ about 2 parts SiC.

The intermediate portion 14, when present, preferably comprises about 50 to 70 v/o nitride ceramic and about 30 to 50 v/o $MoSi_2$ and SiC in a volume ratio of about 1:1.

The highly conductive portion 16 generally has a resistivity of less than about 0.005 ohm-cm, preferably less than about 0.003 ohm-cm, and most preferably less than about 0.001 ohm-cm in the temperature range of 100° to 800° C. It preferably comprises about 30 to 55 v/o nitride ceramic and about 45 to 70 v/o $MoSi_2$ and SiC in a volume ratio of from about 1:1 to about 2:3.

Suitable nitrides for use as the resistive component of the ceramic igniter include silicon nitride, aluminum nitride, boron nitride, and mixtures thereof. Preferably the nitride is aluminum nitride.

Electrical wire leads of the present invention are conventionally connected to the braze pads by a solder. The solder should be able to withstand temperatures of about 485° C. during use without degradation and also must have low resistivity. Generally, a solder having a melting point of above about 500° C., and preferably above about 600° C. is used. Suitable solders typically contain the following compounds in w/o:

| | Typical Embodiment | Preferable Embodiment | More Preferable Embodiment |
|---|---|---|---|
| Silver | 1–90 | 10–70 | 15–60 |
| Copper | 5–80 | 10–70 | 10–60 |
| Zinc | 5–40 | 10–35 | 12–30 |
| Other Metals | 0–40 | 0–30 | 0–30 |

The "Other Metals" described above include one or more metals selected from aluminum, tin, indium, phosphorous, cadmium, and nickel. Suitable solders are commercially available under the trade name Safety-Silv from J. W. Harris Co., Inc. of Cincinnati, Ohio. A specific solder found useful herein is Safety-Silv 45 which nominally contains 45 w/o silver, 30 w/o copper, and 25 w/o zinc. Other specific solders which may be used include Safety-Silv 1200, which nominally contains 56% silver, 22% copper, 17% zinc, and 5% tin, and Safety-Silv 1577 which nominally contains 25% silver, 52.5% copper, and 22.5% zinc.

In soldering the lead wires to the braze pads, it has been found advantageous to introduce the solder directly to the wire-braze pad interface (coated with flux). When a torch is applied to heat the interface, the solder flows onto the wire and onto the brazed region to make a strong, conductive join. In some embodiments, an oxy-acetylene torch is used as the heat source. In other embodiments, a Microflame soldering head system utilizing hydrogen, available from mta/Schunk Automation of Old Saybrook, Conn., is used.

After the igniters are silk screened, they are fired, typically in a graphite fixture, in order to fuse the braze to the ceramic. Generally, the igniters are fired at between about 810° and about 890° C. for about 6–10 minutes in a furnace having a pressure of less than about 0.0001 torr. Alternatively, they may be fired in a continuous belt furnace having an argon atmosphere with a concentration of less than about 50 ppm oxygen.

The igniters of the present invention may be used in many applications, including gas phase fuel ignition applications such as furnaces and cooking appliances. The practice of the present invention can be further appreciated from the following non-limiting Examples and Comparative Examples.

EXAMPLE 1

A double-legged hairpin ("U-shaped") ceramic igniter as shown in FIG. 1 was prepared from aluminum nitride, silicon carbide, and molybdenum disilicide in accordance with the teachings of the Washburn patent. The composition of the ceramic, in v/o, was as follows:

| | Aluminum Nitride | Molybdenum Disilicide | Silicon Carbide |
|---|---|---|---|
| Conductive portion | 50 | 30 | 20 |
| Resistive portion | 60 | 13 | 27. |

Next, an active metal brazing paste, Lucanex 721, manufactured by Lucas-Mihaupt, was heated by means of a refractory metal furnace under a high vacuum to a temperature of 875° C. for about 6 minutes in order to fuse the metal powder braze and chemically react it with the ceramic substrate. The braze was then silk screened onto a 1000 um×2500 um area of each of the legs to form a pad having a thickness of about 150 microns.

To adhere a conventional copper electrical wire to each of the braze pads, Safety-Silv 45 solder is used. The soldering was performed using an oxy-acetylene torch as a heat source. The solder wire was dipped in a standard silver solder flux to flow into the join and clean the surfaces to be joined, allowing the silver solder to melt and flow into the braze pad-wire interface. The heat was removed and the join was held in place for an additional 5 seconds until the solder hardened by cooling.

The ceramic igniters produced by this process were then examined by visual and 20X binocular microscope for cracks in the braze pad. It was observed that less than about 0.4% of the braze pads had cracks.

COMPARITIVE EXAMPLE I

The procedure of Example 1 is repeated identically, except that the braze is merely brushed onto the ceramic substrate. The resulting pad had a thickness of about 200 microns and an area of about 9.0 square millimeters.

The ceramic igniters produced by this process were then examined as above for cracks in the braze pad. It was observed that more than about 30% of the braze pads had cracks. It is believed these cracks are due to the braze pads a volume expansion caused by thermal shock from the heating required in the soldering process.

What is claimed is:

1. A ceramic igniter comprising:

a) a ceramic substrate having first and second conductive ends and a highly resistive middle portion, the conductive ends comprising between 30 volume percent and 55 volume percent nitride ceramic, and b) a braze pad disposed on each conductive end of the ceramic substrate, each pad having a thickness of less than about 150 microns, the braze pad comprising between about 95 weight percent and about 99.9 weight percent of at least one filler metal selected from the group consisting of silver, copper, indium, tin, zinc, lead, cadmium and phosphorous.

2. The igniter of claim 1 wherein each pad has a thickness of less than about 115 microns.

3. The igniter of claim 1 wherein each pad has a thickness of less than about 80 microns.

4. The igniter of claim 1 wherein the conductive ends further comprise between about 45 volume percent and 70 volume percent molybdenum disilicide and silicon carbide.

5. The igniter of claim 4 wherein the braze pad further comprises between about 0.1 and about 5 weight percent of an active metal selected from the group consisting of titanium, zirconium, niobium, nickel, palladium and gold.

6. The ceramic igniter of claim 1 wherein the braze pad comprises titanium, copper and silver.

7. The igniter of claim 1 further comprising:

c) a lead wire disposed on each braze pad.

8. The igniter of claim 7 further comprising: d) a solder which bonds the lead wire to its corresponding braze pad, wherein the solder has a melting point of at least 500° C.

9. The igniter of claim 1 wherein each pad has an exposed surface area of less than about 3.6 square millimeters.

10. The igniter of claim 5 wherein each pad has an exposed surface area of less than about 2.6 square millimeters.

11. The igniter of claim 4 wherein the molybdenum disilicide and silicon carbide are present in the conductive ends in a volume ratio of from about 1:1 to about 2:3.

12. The igniter of claim 8 having no interlayer between the braze pad and the solder.

* * * * *